US010231300B2

(12) United States Patent
Cash et al.

(10) Patent No.: US 10,231,300 B2
(45) Date of Patent: Mar. 12, 2019

(54) SYSTEMS AND METHODS FOR CONTROLLING SOLID STATE LIGHTING DURING DIMMING AND LIGHTING APPARATUS INCORPORATING SUCH SYSTEMS AND/OR METHODS

(71) Applicant: Cree, Inc., Durham, NC (US)

(72) Inventors: Mark Cash, Raleigh, NC (US); Shawn Hill, Raleigh, NC (US)

(73) Assignee: Cree, Inc., Durham, NC (US)

( * ) Notice: Subject to any disclaimer, the term of this patent is extended or adjusted under 35 U.S.C. 154(b) by 371 days.

(21) Appl. No.: 13/742,008

(22) Filed: Jan. 15, 2013

(65) Prior Publication Data

US 2014/0197750 A1 Jul. 17, 2014

(51) Int. Cl.
*H05B 37/02* (2006.01)
*H05B 33/08* (2006.01)

(52) U.S. Cl.
CPC ..... *H05B 33/083* (2013.01); *H05B 33/086* (2013.01)

(58) Field of Classification Search
CPC ..... H05B 33/0827; H05B 33/083; H05B 33/0857; H05B 33/086; H05B 33/0845; H05B 37/02; Y02B 20/343; G09G 3/3406
USPC .... 315/192, 185 R, 307, 291, 193, 294, 297
See application file for complete search history.

(56) References Cited

U.S. PATENT DOCUMENTS 4,743,897 A 5/1988 Perez
4,798,983 A 1/1989 Mori
4,839,535 A 6/1989 Miller
5,334,916 A 8/1994 Noguchi
5,384,519 A 1/1995 Gotoh
5,397,938 A 3/1995 Wihelm et al.
5,521,708 A 5/1996 Beretta
5,847,340 A 12/1998 Godesa
5,929,568 A 7/1999 Eggers
6,385,226 B2 5/2002 McMinn et al.
6,441,558 B1 8/2002 Muthu et al.
(Continued)

FOREIGN PATENT DOCUMENTS

CN 101821544 A 9/2010
CN 101889475 A 11/2010
(Continued)

OTHER PUBLICATIONS

International Search Report and Written Opinion Corresponding to International Application No. PCT/US2014/032393; dated Aug. 11, 2014; 14 Pages.

(Continued)

*Primary Examiner* — Alexander H Taningco
*Assistant Examiner* — Kurtis R Bahr
(74) *Attorney, Agent, or Firm* — Myers Bigel, P.A.

(57) ABSTRACT

A lighting apparatus having a plurality of light-emitting devices (LEDs) can include at least one first LED that is configured to emit first chromaticity light, at least one second LED that is configured to emit second chromaticity light, and at least one additional LED that is configured to emit third chromaticity light. A control circuit can be operatively coupled to the plurality of light-emitting devices and configured to cause a color temperature produced by the plurality of LEDs to vary substantially in conformance with a Planckian locus in response to a dimming control input less than about 1800K.

27 Claims, 11 Drawing Sheets

(56) References Cited

U.S. PATENT DOCUMENTS 6,498,440 B2 12/2002 Stam et al.
6,617,795 B2 9/2003 Bruning
6,636,003 B2 10/2003 Rahm et al.
6,697,130 B2 2/2004 Weindorf et al.
6,753,661 B2 6/2004 Muthu et al.
6,781,329 B2 8/2004 Mueller et al.
6,788,011 B2 9/2004 Mueller et al.
6,864,641 B2 3/2005 Dygert
6,885,035 B2 4/2005 Bhat et al.
6,897,624 B2 5/2005 Lys et al.
6,998,594 B2 2/2006 Gaines et al.
7,038,399 B2 5/2006 Lys et al.
7,067,995 B2 6/2006 Gunter et al.
7,091,874 B2 8/2006 Smithson
7,161,313 B2 1/2007 Piepgras et al.
7,186,003 B2 3/2007 Dowling et al.
7,213,940 B1 5/2007 Van de Ven et al.
7,233,831 B2 6/2007 Blackwell
7,238,898 B1 7/2007 Czarnecki
7,245,089 B2 7/2007 Yang
7,352,138 B2 4/2008 Lys et al.
7,358,679 B2 4/2008 Lys et al.
7,385,359 B2 6/2008 Dowling et al.
7,432,668 B2 10/2008 Zwanenburg et al.
7,515,128 B2 4/2009 Dowling
7,772,757 B2 8/2010 Kane et al.
7,812,553 B2 10/2010 Kang et al.
7,821,194 B2 10/2010 Negley et al.
7,967,652 B2 6/2011 Emerson
2001/0032985 A1 10/2001 Bhat et al.
2002/0047624 A1 4/2002 Stam et al.
2004/0105261 A1 6/2004 Ducharme et al.
2004/0233145 A1 11/2004 Chiang
2004/0245946 A1 12/2004 Halter
2005/0007164 A1 1/2005 Callahan, Jr.
2005/0047134 A1 3/2005 Mueller et al.
2005/0122065 A1 6/2005 Young
2005/0127381 A1 6/2005 Vitta et al.
2005/0162100 A1* 7/2005 Romano ..... H05B 39/08 315/291
2005/0243022 A1 11/2005 Negru
2005/0280376 A1 12/2005 Hamidian et al.
2006/0016960 A1 1/2006 Morgan et al.
2006/0076908 A1 4/2006 Morgan et al.
2006/0081773 A1 4/2006 Rains et al.
2006/0152172 A9 7/2006 Mueller et al.
2006/0226956 A1 10/2006 Young et al.
2006/0273331 A1 12/2006 Lim et al.
2007/0040512 A1 2/2007 Jungwirth et al.
2007/0061883 A1 3/2007 Rains et al.
2007/0115228 A1 5/2007 Roberts et al.
2007/0115662 A1 5/2007 Roberts et al.
2007/0139920 A1 6/2007 van der Ven et al.
2007/0170447 A1 7/2007 Negley et al.
2007/0235751 A1 10/2007 Radkov et al.
2007/0247089 A1 10/2007 Summerland
2007/0263393 A1 11/2007 van der Ven
2007/0267983 A1 11/2007 van de Ven et al.
2007/0273299 A1* 11/2007 Miskin ..... H05B 33/0818 315/250
2008/0001547 A1 1/2008 Negru
2008/0037257 A1 2/2008 Bolta
2008/0043464 A1 2/2008 Ashdown
2008/0062070 A1 3/2008 De Oto et al.
2008/0094000 A1 4/2008 Yamamoto et al.
2008/0116818 A1 5/2008 Shteynberg et al.
2008/0136331 A1 6/2008 Schmeikal
2008/0179602 A1 7/2008 Negley et al.
2008/0215279 A1 9/2008 Salsbury et al.
2008/0304260 A1 12/2008 van de Ven et al.
2009/0079362 A1 3/2009 Shteynberg et al.
2009/0160363 A1 6/2009 Negley et al.
2009/0184616 A1 7/2009 van de Ven et al.
2009/0189529 A1 7/2009 Negley et al.
2009/0206758 A1 8/2009 Kobilke
2009/0237004 A1 9/2009 Ploquin et al.
2009/0243509 A1 10/2009 Barnett et al.
2009/0315480 A1 12/2009 Yan et al.
2010/0001648 A1 1/2010 De Clerq et al.
2010/0002440 A1 1/2010 Negley et al.
2010/0072903 A1 3/2010 Blaut et al.
2010/0079262 A1 4/2010 Van Laanen
2010/0090604 A1 4/2010 Maruyama et al.
2010/0102199 A1 4/2010 Negley et al.
2010/0103660 A1 4/2010 van de Ven et al.
2010/0109550 A1 5/2010 Huda et al.
2010/0109570 A1 5/2010 Weaver
2010/0127282 A1 5/2010 Harbers et al.
2010/0127283 A1 5/2010 van de Ven et al.
2010/0134018 A1 6/2010 Tziony et al.
2010/0141159 A1 6/2010 Shiu et al.
2010/0171444 A1 7/2010 Bennette
2010/0244707 A1 9/2010 Gaines et al.
2010/0259182 A1 10/2010 Man et al.
2010/0308738 A1 12/2010 Shteynberg et al.
2010/0308739 A1 12/2010 Shteynberg et al.
2010/0315012 A1 12/2010 Kim et al.
2011/0037413 A1 2/2011 Negley et al.
2011/0057571 A1 3/2011 Ackermann et al.
2011/0062872 A1 3/2011 Jin et al.
2011/0068696 A1 3/2011 van de Ven et al.
2011/0068701 A1* 3/2011 van de Ven ..... H05B 33/083 315/185 R
2011/0068702 A1 3/2011 van de Ven et al.
2011/0084614 A1 4/2011 Eisele et al.
2011/0101883 A1 5/2011 Grajcar
2011/0115407 A1 5/2011 Wibben et al.
2011/0199003 A1 8/2011 Muguruma et al.
2011/0210674 A1 9/2011 Melanson
2011/0210678 A1 9/2011 Grajcar
2011/0254525 A1 10/2011 Gaknoki et al.
2011/0279061 A1 11/2011 Lee et al.
2012/0025713 A1 2/2012 Ribarich et al.
2012/0104953 A1 5/2012 Chobot
2012/0153844 A1 6/2012 Chobot
2012/0176826 A1 7/2012 Lazar
2012/0201025 A1 8/2012 Cash
2012/0206048 A1 8/2012 Yang
2012/0300452 A1* 11/2012 Harbers ..... H05B 33/0803 362/231
2012/0306375 A1 12/2012 van de Ven
2013/0002167 A1 1/2013 van de Ven
2013/0026923 A1 1/2013 Athalye et al.
2013/0069561 A1 3/2013 Melanson et al.
2013/0077299 A1 3/2013 Hussell et al.
2013/0082610 A1 4/2013 Bradford
2013/0154508 A1 6/2013 Gilliom
2013/0169159 A1* 7/2013 Lys ..... H05B 33/083 315/122
2013/0207559 A1* 8/2013 Ferrier ..... H05B 33/0812 315/192
2014/0159584 A1 6/2014 Grajcar
2016/0066381 A1 3/2016 Despesse

FOREIGN PATENT DOCUMENTS

JP H06224720 8/1994
JP 3412702 6/2003
JP 2003-273404 A 9/2003
JP 2007-059260 3/2007
JP 2007-110075 4/2007
JP 2008059811 3/2008
JP 2008-226473 9/2008
JP 2009-049010 A 3/2009
JP 2010-008694 1/2010
JP 2010503164 A 1/2010
JP 2011-508939 A 3/2011
KR 10-2010-0040242 4/2010
KR 10-2011-0028204 A 3/2011
WO WO 03/096761 11/2003
WO WO 2003/096761 A1 11/2003
WO WO 2008/129485 A1 10/2008
WO WO 2009/049019 4/2009

(56) References Cited

FOREIGN PATENT DOCUMENTS

| | | |
|---|---|---|
| WO | WO 2010/012999 | 2/2010 |
| WO | WO 2011/037752 A2 | 3/2011 |
| WO | WO 2011/037774 A1 | 3/2011 |

OTHER PUBLICATIONS

International Preliminary Report on Patentability Corresponding to International Application No. PCT/US2012/040189; dated Dec. 19, 2013; 13 Pages.
International Search Report and Written Opinion Corresponding to International Application No. PCT/US2012/039984; dated Nov. 30, 2012; 10 Pages.
International Search Report and Written Opinion Corresponding to International Application No. PCT/US2012/064434; dated Jan. 25, 2013; 11 Pages.
International Search Report and Written Opinion Corresponding to International Application No. PCT/US2012/040189; dated Aug. 20, 2012; 15 Pages.
Rensselaer Polytechnic Institute, "What is color consistency?". NLPIP, Lighting Research Center, vol. 8, Issue 1, Oct. 2004, 3 Pages, Retrieved from http://www.Irc.rpi.edu/prodrams/nlpip/lightinganswers/lightsources/whatisColorConsistency.asp.
Sutardja, P., "Design for High Quality and Low Cost SSL with Power Factor Correction", Marvell Semiconductor Inc. Jul. 2011. 16 pages.
Chinese Office Action Corresponding to Chinese Patent Application No. 201280034828.8; dated Jan. 5, 2015; Foreign Text, 14 Pages, English Translation Thereof, 9 Pages.
International Search Report and Written Opinion Corresponding to International Patent Application No. PCT/US14/68534; dated Mar. 4, 2015; 13 Pages.
European Search Report Corresponding to Patent Application No. 12 79 2795; dated Nov. 11, 2015; 7 Pages.
Japanese Decision of Rejection Corresponding to Patent Application No. 2014-513696; dated Oct. 14, 2015; Foreign Text, 2 Pages, English Translation Thereof, 2 Pages.
Hardware Zonbe News "Agilent Technologies Introduces breakthrough flat-panel TV illumination system that delivers 25 percent more brilliant colors", Jan. 7, 2005.
Chinese First Office Action Corresponding to Chinese Patent Application No. 201280062008.X; dated Jul. 6, 2015; Foreign Text, 6 Pages, English Translation Thereof, 7 Pages.
European Search Report Corresponding to European Patent Application No. 12 85 0396; dated Jun. 21, 2016; 6 Pages.
International Preliminary Report on Patentability Corresponding to International Application No. PCT/US2014/068534; dated Jun. 16, 2016; 13 Pages.
Korean Notice of Preliminary Rejection Corresponding to Korean Application No. 10-2012-7029011; dated May 10, 2016; Foreign Text, 6 Pages, English Translation Thereof, 5 Pages.
Notice of Preliminary Rejection Corresponding to Patent Application No. 10-2012-7029011; dated Nov. 19, 2015; 15 pages.
Author: James Frederick Lazar, Title: U.S. Utility provisional patent application for source and muitiple loads regulator (61/431,435), Date: Jan. 11, 2011.
Author: James Frederick Lazar, Title: U.S. Utility provisional patent application for source and multiple loads regulator (61/431,435), Date: Jan. 11, 2011 (Drawings).
E. Fred Schurbert, "Light Emitting Diodes", Second Edition, Cambridge University Press, 2006, 87 pages.
European Search Report Corresponding to Application No. 12 85 0396; dated Nov. 4, 2016; 11 Pages.
Notice of Preliminary Rejection dated Jan. 16, 2017 issued for corresponding Korean Application No. 10-2012-7029011 (including English translation).

* cited by examiner

SYSTEMS AND METHODS FOR CONTROLLING SOLID STATE LIGHTING DURING DIMMING AND LIGHTING APPARATUS INCORPORATING SUCH SYSTEMS AND/OR METHODS

FIELD OF THE INVENTION

The present invention relates to lighting apparatus and methods and, more particularly, to solid state lighting apparatus and methods.

BACKGROUND

Solid state lighting arrays are used for a number of lighting applications. For example, solid state lighting panels including arrays of solid state light emitting devices have been used as direct illumination sources, for example, in architectural and/or accent lighting. A solid state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Visible light may include light having many different wavelengths. The apparent color of visible light can be illustrated with reference to a two dimensional chromaticity diagram, such as the 1931 International Conference on Illumination (CIE) Chromaticity Diagram illustrated in FIG. 1A, and the 1976 CIE u'v' Chromaticity Diagram shown in FIG. 1B, which is similar to the 1931 Diagram but is modified such that similar distances on the 1976 u'v' CIE Chromaticity Diagram represent similar perceived differences in color. These diagrams provide useful reference for defining colors as weighted sums of colors.

In the 1976 CIE Chromaticity Diagram, chromaticity values are plotted using scaled u- and v-parameters which take into account differences in human visual perception. That is, the human visual system is more responsive to certain wavelengths than others. For example, the human visual system is more responsive to green light than red/orange light. The 1976 CIE-u'v' Chromaticity Diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, such as the 1931 CIE Chromaticity Diagram, two colors that are not distinguishably different may be located farther apart on the graph than two colors that are distinguishably different.

As shown in FIG. 1A, colors on a 1931 CIE Chromaticity Diagram are defined by x and y coordinates (i.e., chromaticity coordinates, or color points) that fall within a generally U-shaped area. Colors on or near the outside of the area are saturated colors composed of light having a single wavelength, or a very small wavelength distribution. Colors on the interior of the area are unsaturated colors that are composed of a mixture of different wavelengths. White light, which can be a mixture of many different wavelengths, is generally found near the middle of the diagram, in the region labeled 100 in FIG. 1A. There are many different hues of light that may be considered "white," as evidenced by the size of the region 100. For example, some "white" light, such as light generated by sodium vapor lighting devices, may appear yellowish in color, while other "white" light, such as light generated by some fluorescent lighting devices, may appear more bluish in color.

Light that generally appears green is plotted in the regions 101, 102 and 103 that are above the white region 100, while light below the white region 100 generally appears pink, purple or magenta. For example, light plotted in regions 104 and 105 of FIG. 1A generally appears magenta (i.e., red-purple or purplish red).

It is further known that a binary combination of light from two different light sources may appear to have a different color than either of the two constituent colors. The color of the combined light may depend on the relative intensities of the two light sources. For example, light emitted by a combination of a blue source and a red/orange source may appear purple or magenta to an observer. Similarly, light emitted by a combination of a blue source and a yellow source may appear white to an observer.

Also illustrated in FIG. 1A is the Planckian locus 106, which corresponds to the location of color points of light emitted by a black-body radiator that is heated to various temperatures. In particular, FIG. 1A includes temperature listings along the Planckian locus. These temperature listings show the color path of light emitted by a black-body radiator that is heated to such temperatures. As a heated object becomes incandescent, it first glows reddish, then yellowish, then white, and finally bluish, as the wavelength associated with the peak radiation of the black-body radiator becomes progressively shorter with increased temperature. Illuminants which produce light which is on or near the Planckian locus can thus be described in terms of their correlated color temperature (CCT).

The chromaticity of a particular light source may be referred to as the "color point" of the source. For a white light source, the chromaticity may be referred to as the "white point" of the source. As noted above, the white point of a white light source may fall along the Planckian locus. Accordingly, a white point may be identified by a correlated color temperature (CCT) of the light source. White light typically has a CCT of between about 2000 K and 10000 K. White light with a CCT of 3000 may appear yellowish in color, while light with a CCT of 8000 K may appear more bluish in color. Color coordinates that lie on or near the Planckian locus at a color temperature between about 2500 K and 8000 K may yield pleasing white light to a human observer.

"White" light also includes light that is near, but not directly on the Planckian locus. A Macadam ellipse can be used on a 1931 CIE Chromaticity Diagram to identify color points that are so closely related that they appear the same, or substantially similar, to a human observer. A Macadam ellipse is a closed region around a center point in a two-dimensional chromaticity space, such as the 1931 CIE Chromaticity Diagram, that encompasses all points that are visually indistinguishable from the center point. A seven-step Macadam ellipse captures points that are indistinguishable to an ordinary observer within seven standard deviations, a ten step Macadam ellipse captures points that are indistinguishable to an ordinary observer within ten standard deviations, and so on. Accordingly, light having a color point that is within about a ten step Macadam ellipse of a point on the Planckian locus may be considered to have a substantially similar color as the point on the Planckian locus.

The ability of a light source to accurately reproduce color in illuminated objects is typically characterized using the color rendering index (CM). In particular, CRI is a relative measurement of how the color rendering properties of an illumination system compare to those of a reference illuminator, with a reference illuminator for a CCT of less than 5000K being a black-body radiator. For CCT of 5000K and above, the reference illuminator is a spectrum defined by the CIE which is similar to the spectrum of sunlight at the earth's surface. The CRI equals 100 if the color coordinates of a set of test colors being illuminated by the illumination system are the same as the coordinates of the same test colors being irradiated by the reference illuminator. Daylight has the highest CRI (of 100), with incandescent bulbs being relatively close (about 95), and fluorescent lighting being less accurate (70-85).

Generally speaking, incandescent bulbs tend to produce more natural-appearing illumination than other types of conventional lighting devices. In particular, incandescent bulbs typically go from a color temperature of about 2700K at full brightness to a color temperature of about 2000 k at 5% brightness and to a color temperature of about 1800K at about 1% brightness. This compares favorably with daylight, which varies from about 6500K at midday to about 2500 k at sunrise and sunset. Research indicates that people tend to prefer warmer color temperatures at low brightness levels and in intimate settings.

In illumination applications, it is often desirable to provide a lighting source that generates a light with a color behavior that approximates the behavior of incandescent lighting. LED-lighting units have been proposed that may be coupled to an AC dimmer circuit and approximate the lighting variation of a conventional incandescent light as the dimmer circuit increases or decreases the brightness of the generated light, as described in U.S. Pat. No. 7,038,399 to Lys et al.

One difficulty with solid state lighting systems including multiple solid state devices is that the manufacturing process for LEDs typically results in variations between individual LEDs. This variation is typically accounted for by binning, or grouping, the LEDs based on brightness, and/or color point, and selecting only LEDs having predetermined characteristics for inclusion in a solid state lighting system. LED lighting devices may utilize one bin of LEDs, or combine matched sets of LEDs from different bins, to achieve repeatable color points for the combined output of the LEDs.

One technique to tune the color point of a lighting fixture is described in commonly assigned United States Patent Publication No. 2009/0160363, the disclosure of which is incorporated herein by reference. The '363 application describes a system in which phosphor converted LEDs and red/orange LEDs are combined to provide white light. The ratio of the various mixed colors of the LEDs is set at the time of manufacture by measuring the output of the light and then adjusting string currents to reach a desired color point. The current levels that achieve the desired color point are then fixed for the particular lighting device. LED lighting systems employing feedback to obtain a desired color point are described in U.S. Publication Nos. 2007/0115662 and 2007/0115228 and the disclosures of which are incorporated herein by reference.

SUMMARY

Embodiments according to the invention can provide systems and methods for controlling solid state lighting during dimming and lighting apparatus incorporating such systems and/or methods. Pursuant to such embodiments, a lighting apparatus having a plurality of light-emitting devices (LEDs) can include at least one first LED that is configured to emit first chromaticity light, at least one second LED that is configured to emit second chromaticity light, and at least one additional LED that is configured to emit third chromaticity light. A control circuit can be operatively coupled to the plurality of light-emitting devices and configured to cause a color temperature produced by the plurality of LEDs to vary substantially in conformance with a Planckian locus in response to a dimming control input less than about 1800K.

In some embodiments according to the invention, the at least one first LED can be a red/orange LED, the at least one second LED can be a Blue-Shifted-Yellow (BSY) LED, and the at least one additional LED can be an amber LED. In some embodiments according to the invention, the apparatus can further include a bypass circuit, that can be operatively coupled to the control circuit, where the bypass circuit can include a variable resistance circuit and the at least one amber LED, where the variable resistance circuit can be configured to increasingly bypass current around the at least one BSY LED through the at least one amber LED as the dimming control input decreases a brightness level of the plurality of LEDs.

In some embodiments according to the invention, the at least one BSY LED can be a first BSY LED that is configured to emit first BSY light and the plurality of LEDs can include a second BSY LED that is configured to emit second BSY light having greater yellow content than the first BSY light, where the apparatus can further include a second bypass circuit, operatively coupled to the control circuit, where the second bypass circuit can include a second variable resistance circuit and a second amber LED, where the second variable resistance circuit can be configured to increasingly bypass current around the second BSY LED through the second amber LED as the dimming control input decreases the brightness level of the plurality of LEDs.

In some embodiments according to the invention, the plurality of LEDs are arranged in a serially connected LED string, where the apparatus can further include a bypass circuit, coupled in parallel across the at least one amber LED in the LED string, the bypass circuit can be operatively coupled to the control circuit and can be configured to increasingly bypass current around the at least one amber LED as the dimming control input increases a brightness level of the plurality of LEDs.

In some embodiments according to the invention, the plurality of LEDs can include a first LED string that includes the at least one BSY LED coupled in series with the at least one red/orange LED. A second LED string, coupled in parallel with the first LED string, can include the at least one amber LED, where the control circuit can be configured to increase current through the first LED string while decreasing current through the second string of LEDs as the dimming control input increases a brightness level of the plurality of LEDs.

In some embodiments according to the invention, the apparatus can further include a bypass circuit that can be coupled across the at least one amber LED and can be operatively coupled to the control circuit, where the bypass circuit can be configured to increasingly bypass current around the at least one amber LED as the dimming control input increases the brightness level of the plurality of LEDs.

In some embodiments according to the invention, the plurality of LEDs can include a first LED string including the at least one BSY LED coupled in series with the at least one red/orange LED. A second LED string, coupled in parallel with the first LED string, can include the at least one amber LED and an RC circuit can be coupled in series with the second LED string, and can be configured to discharge through the second LED string when the first string of LEDs is off.

In some embodiments according to the invention, a lighting apparatus can include a control circuit that can be operatively coupled to a plurality of light-emitting devices (LEDs) and can be configured to reduce current through at least one first chromaticity LED included in the plurality while increasing current through at least one additional chromaticity LED included in the plurality to cause a color temperature less than about 1800K produced by the plurality of LEDs to vary substantially in conformance with a Planckian locus in response to a dimming control input.

In some embodiments according to the invention, a method of operating a lighting apparatus including a plurality of light-emitting devices (LEDs) that includes at least one first LED configured to emit first chromaticity light, at least one second LED configured to emit second chromaticity light, and at least one additional LED configured to emit additional chromaticity light, can be provided by reducing current through the at least one second LED and increasing current through the at least one additional LED, while reducing the current through the at least one second LED, to cause a color temperature produced by the plurality of LEDs to vary substantially in conformance with a Planckian locus in response to a dimming control input.

DETAILED DESCRIPTION OF EMBODIMENTS

Figure 1A:
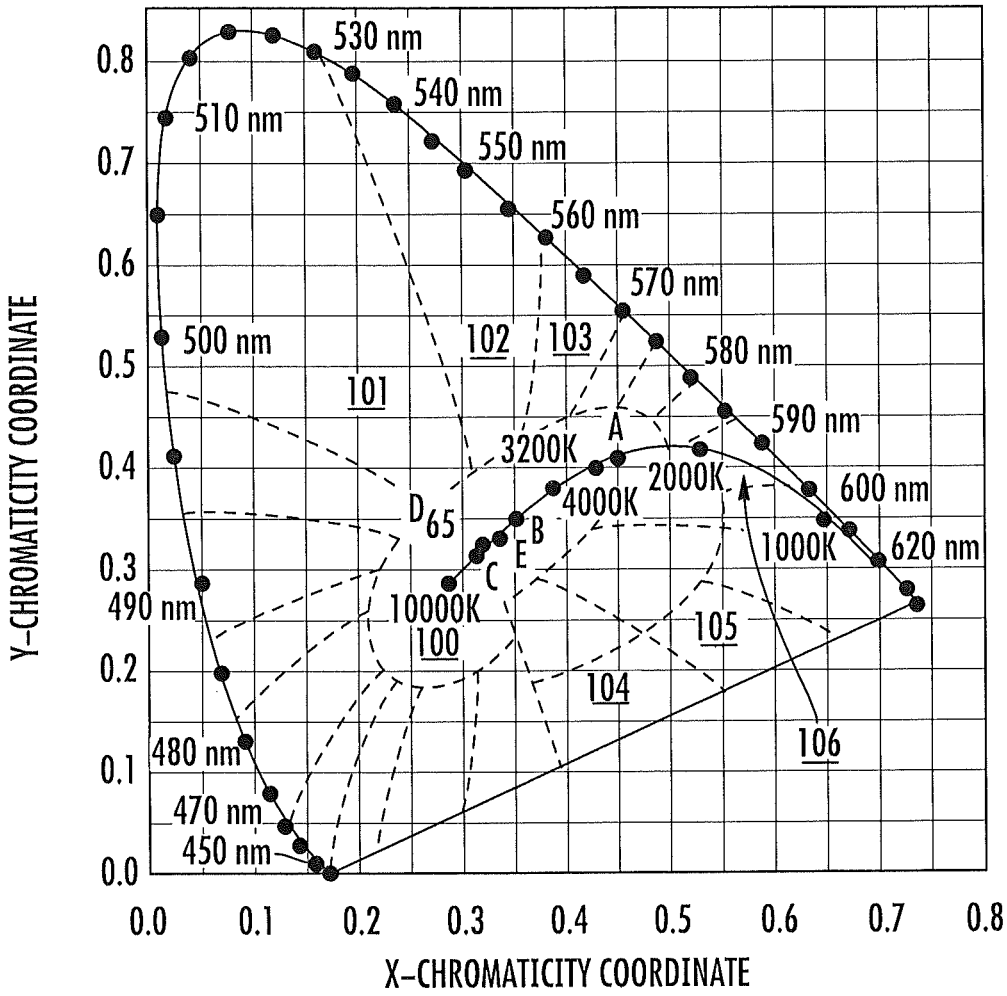
FIG. 1A is a chromaticity diagram illustrating a Planckian locus using x and y chromaticity coordinates.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The following description of some embodiments of the inventive subject matter refers to "light-emitting devices," which may include, but is not limited to, solid-state lighting devices, such as light emitting diode (LED) devices. As used herein, "LED" includes, but is not limited to, direct-emission devices that produce light when a voltage is applied across a PN junction thereof, as well as combinations of such direct-emission devices with luminescent materials, such as phosphors that emit visible-light radiation when excited by a source of radiation, such as a direct-emission device.

Embodiments of the present invention provide systems and methods for controlling solid state lighting devices and lighting apparatus incorporating such systems and/or methods. In some embodiments, the present invention can be utilized in connection with bypass circuits, using the current sensed in the LED string and the temperature associated therewith, as described in co-pending and commonly assigned U.S. patent application Ser. No. 12/566,195 entitled "Solid State Lighting Apparatus with Controllable Bypass Circuits and Methods of Operating Thereof", co-pending and commonly assigned U.S. patent application Ser. No. 12/704,730 entitled "Solid State Lighting Apparatus with Compensation Bypass Circuits and Methods of Operation Thereof" and co-pending and commonly assigned U.S. patent application Ser. No. 12/566,142 entitled "Solid State Lighting Apparatus with Configurable Shunts", the disclosures of which are incorporated herein by reference. Temperature compensation is described in co-pending and commonly assigned U.S. patent application Ser. No. 13/565,166, entitled "Temperature Curve Compensation Offset" the disclosure of which is incorporated herein by reference.

Figure 2A:
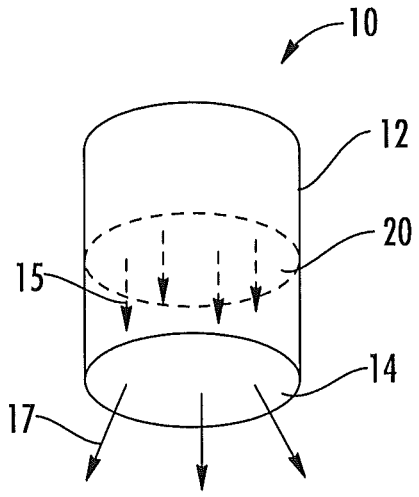
FIGS. 2A and 2B illustrate a solid state lighting apparatus in some embodiments according to the invention.
Figure 2B:
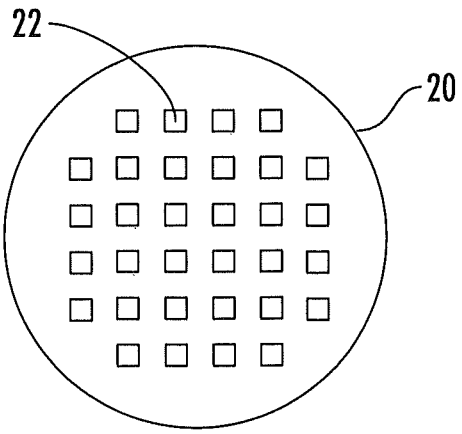

Referring to FIGS. 2A and 2B, a lighting apparatus 10 according to some embodiments is illustrated. The lighting apparatus 10 shown in FIGS. 2A and 2B is a "recessed downlight" or "can" lighting fixture that may be suitable for use in general illumination applications as a down light or spot light. However, it will be appreciated that a lighting apparatus according to some embodiments may have a different form factor. For example, a lighting apparatus according to some embodiments can have the shape of a conventional light bulb, a pan or tray light, an automotive headlamp, or any other suitable form.

The lighting apparatus 10 generally includes a can shaped outer housing 12 in which a lighting panel 20 is arranged. In the embodiments illustrated in FIGS. 2A and 2B, the lighting panel 20 has a generally circular shape so as to fit within an interior of the cylindrical housing 12. Light is generated by solid state lighting devices (LEDs) 22, which are mounted on the lighting panel 20, and which are arranged to emit light 15 towards a diffusing lens 14 mounted at the end of the housing 12. Diffused light 17 is emitted through the lens 14. In some embodiments, the lens 14 may not diffuse the emitted light 15, but may redirect and/or focus the emitted light 15 in a desired near-field or far-field pattern. The LEDs 22 may include LEDs of different chromaticities that may be selectively controlled to produce a desired intensity, correlated color temperature (CCT) and/or color rendering index (CRI) using various techniques discussed in detail below.

As appreciated by the present inventors, some solid state lighting solutions are unable to provide light which adequately follows the Planckian locus illustrated in FIGS. 1A/1B. In particular, as some conventional lighting systems are dimmed toward the lower ranges of the Planckian locus (for example, below 1800K) the light produced by the apparatus may appear to be too red. As further appreciated by the present inventors, an additional LED device may be added to a lighting apparatus that already includes LEDs selected from bins such as blue-shifted-yellow and red/orange.

The additional LEDs can be selected to provide an additional v' lighting component to selectively shift the chromaticity of the combined light generated by the LEDs in a direction in the u'-v' space, that allows the light to more closely follow the Planckian locus over a wide range of dimming. For example, in some embodiments according to the invention, the lighting apparatus may already include a combination of blue-shifted-yellow LEDs and red/orange LEDs. Without an additional LED, however, as the light from the apparatus is dimmed (for example, below about 1800K) the light generated by the lighting apparatus may be a result of a combination of the blue-shifted-yellow LEDs and the red/orange LEDs, which may cause the chromaticity of the light output of the apparatus to fall below the Planckian locus in the chromaticity space shown in FIG. 1. To address this, the additional LEDs can add an additional v' component, for example, when the dimming of the lighting apparatus reaches the point where the combination of the blue-shifted-yellow and red/orange LEDs would otherwise produce light having a chromaticity that is below the Planckian locus.

For example, in some embodiments according to the invention, as the lighting apparatus produces dimmer light, some of the current passing through the blue-shifted-yellow LEDs can be bypassed through additional LED components thereby providing increasingly greater amounts of the v' component to shift the chromaticity of the combined light from the apparatus toward the Planckian locus as the dimming progresses.

In some embodiments according to the invention, the additional LEDs can be amber LEDs that are configured to emit amber light which generates light having a dominate wavelength in a range from about 585 nm to about 500 nm. The amber LEDs are positioned in the CIE chromaticity diagram so as to provide the additional v' component so that the combined light generated by the lighting apparatus can follow the Planckian locus over a wider range of dimming than in conventional systems. Although amber LEDs are described herein as being used as the additional LEDs in such lighting apparatus, it will be understood that any LED that is configured to emit a color that is situated in the CIE chromaticity space so as to provide the needed v' component used to shift the chromaticity of the light generated by the apparatus onto the Planckian locus, may be utilized.

Figure 1B:
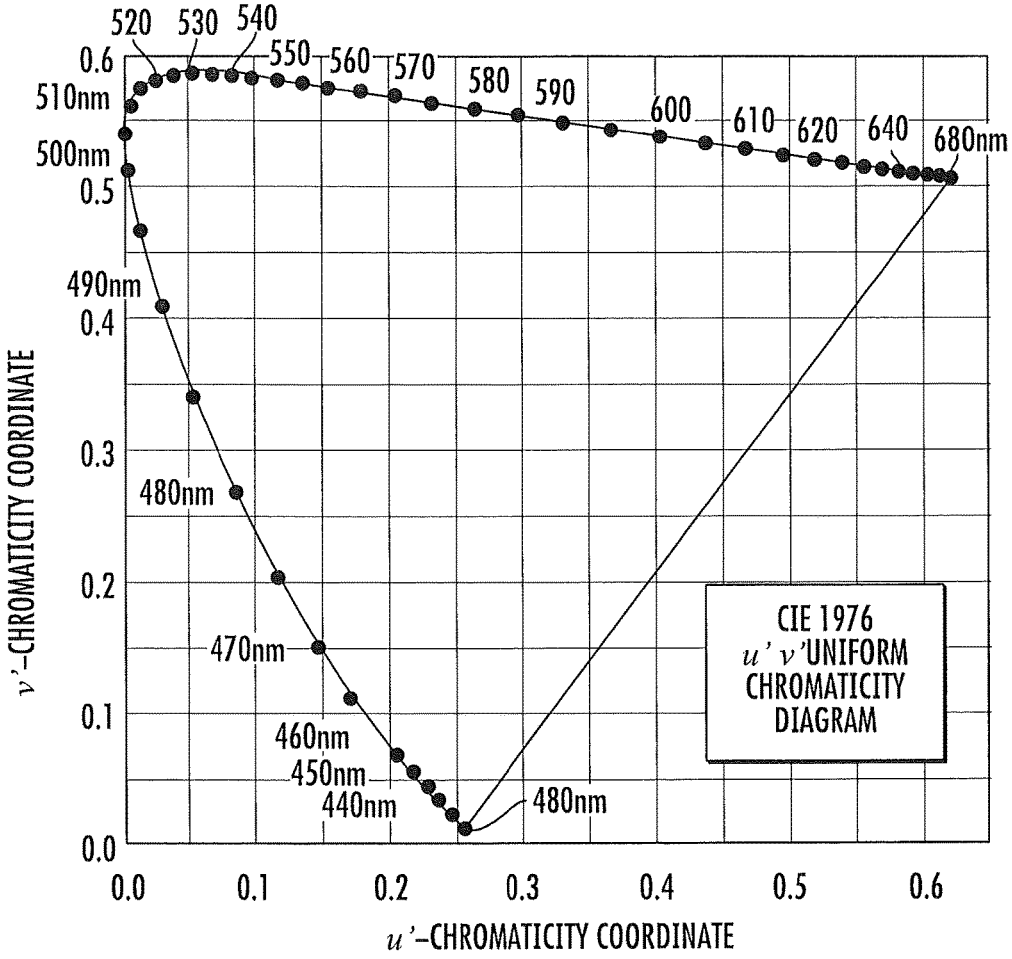
FIG. 1B is a chromaticity diagram using u' and v' chromaticity coordinates.
Figure 3:
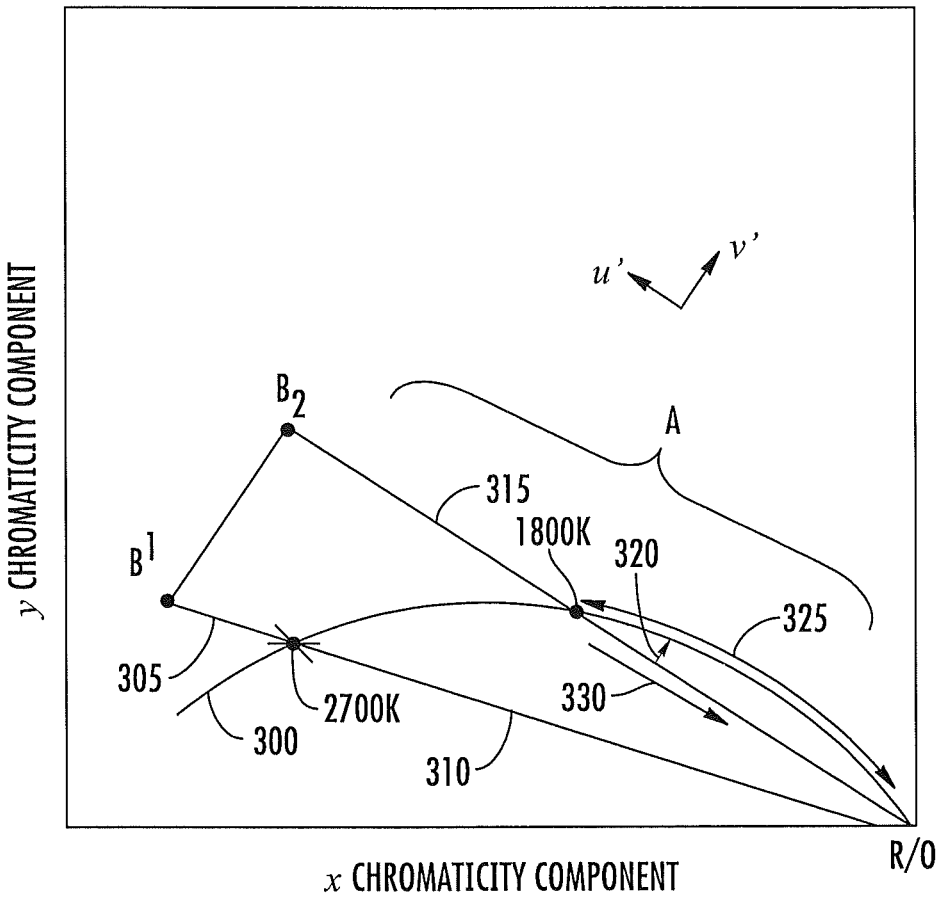
FIG. 3 is a portion of an x-y chromaticity diagram (annotated with an offset u' and v' coordinate system) illustrating the Planckian locus overlayed with points illustrating different chromaticities associated with LEDs including additional LEDs in some embodiments according to the invention.

FIG. 3 is a schematic representation of a portion of the CIE chromaticity diagram shown in FIG. 1 (annotated with an offset u' and v' coordinate system) overlayed with the additional v' component generated by the additional LEDs in some embodiments according to the invention. According to FIG. 3, LEDs B1 correspond to blue-shifted-yellow (BSY) LEDs that are configured to emit BSY light, whereas LEDs B2 correspond to BSY LEDs that are configured to emit BSY light that has a greater yellow content than the LEDs B1. Accordingly, BSY LEDs B1 and B2 are shown separated from one another in the chromaticity space of FIG. 3. Also, the red/orange LEDs R/O are configured to emit red/orange light and are shown near the lowest end of the Planckian locus 300 corresponding to when the light generated by the apparatus is at the lowest level of brightness.

As further shown in FIG. 3, the additional LEDs A are shown situated in the chromaticity space above a locus 315 that connects the BSY LEDs B2 and the red/orange LEDs R. Situating the additional LEDs A in this portion of the chromaticity space allows for the generation of an additional v' component 320 that allows the light to be shifted toward the Planckian locus 300 when the dimming level results in the apparatus generating light that is less than 1800K.

For example, in operation, each of the LEDs shown can be configured to emit its respective light all of which are combined to generate combined light that should ideally follow the Planckian locus 300 over the widest range of dimming. Initially, the BSY LEDs B1 and the red/orange LEDS R/O can generate light which combines to produce 2700K output which falls directly on the Planckian locus 300. This output is generated by the light output 305 from the BSY LED B1 and a light 310 generated by the red/orange LEDs R/O to place the light output on the Planckian locus at 2700K. As the light output from the apparatus is dimmed, however, the BSY LEDs B2 can be included in the generation of light to shift combined light from the apparatus upward in the v' direction to follow the Planckian locus as the dimming proceeds towards 1800K.

Once the dimming reaches 1800K, however, it is shown that the portion of the Planckian locus 325 below 1800K, extends beyond the locus 315 that connects the BSY LEDs B2 and the red/orange LEDs R/O. Accordingly, and as appreciated by the present inventors, if no additional LED components are provided, the light generated by the apparatus may follow the remainder of the locus 315 that connects the BSY LEDs B2 and the red/orange LEDs R/O below 1800K. The inclusion of the additional LEDs, however, provides for the additional v' component 320 that can shift the light generated by the apparatus upward in the v' direction to more closely follow the portion of the Planckian locus 325 that falls below 1800K as the light provided by the apparatus is further dimmed.

It will be understood that although the representation shown in FIG. 3 shows 3 types of LEDs utilized with the additional LEDs (i.e., the two BSY type LEDs along with the red/orange LEDs) it will be understood that some embodiments according to the invention, an apparatus may be provided which includes 2 types of LEDs: a BSY LED, a red/orange LED, along with the additional LED, which is configured to emit light to provide the v' component as discussed herein.

It will be understood that in some embodiments according to the invention, the BSY and R/O LEDs can be any chromaticity LEDs that can be used to generate dimmable light that can follow the Plankian locus 300 until the additional LED is used to shift the light using the additional v' component 320. Accordingly, the inclusion of BSY and R/O (and amber) LEDs in some embodiments is for the purpose of illustration and is not intended to be a limitation as to what chromaticity LEDs may be used in embodiments according to the invention.

BSY devices may include, for example, LED devices that include a combination of a blue excitation diode and a phosphor, as described in U.S. Pat. No. 7,213,940, issued May 8, 2007, and entitled "LIGHTING DEVICE AND LIGHTING METHOD," the disclosure of which is incorporated herein by reference. As described therein, a lighting device may include solid state light emitters (i.e., LED devices) which emit light having dominant wavelength in ranges of from 430 nm to 480 nm, and a group of phosphors which emit light having dominant wavelength in the range of from 555 nm to 585 nm. A combination of light by the first group of emitters, and light emitted by the group of phosphors produces a sub-mixture of light having x, y color coordinates within a BSY area on a 1931 CIE Chromaticity Diagram. Such non-white light may, when combined with light having a dominant wavelength from 600 nm to 630 nm, can be used to produce warm white light over a portion of the Planckian locus that is subjected to a wider range of dimming. U.S. Pat. No. 7,821,194, issued Oct. 26, 2010 and entitled "SOLID STATE LIGHTING DEVICES INCLUDING LIGHT MIXTURES," the disclosure of which is incorporate herein by reference.

It will be understood that production LEDs generally exhibit variation in chromaticity, e.g., LEDs in a lot of BSY LEDs may vary in chromaticity. "Bins" may be defined for such BSY LEDS, e.g., respective bins may be assigned respective ranges of chromaticity values, and LEDs may be sorted according to where they fall with respect to these ranges. In some embodiments, bluer BSY LEDs may be selected from a first bin and yellower BSY LEDs may be selected from a second bin such that, for example, there is v' variation of 0.005 or greater between the first and second bins.

As further described herein, the additional v' component described above can be provided by, for example, controlling the different LEDs to reduce the current through at least one of the BSY LEDs while also increasing the current through at least one additional LED to cause a color temperature that varies substantially in conformance with the Planckian locus in response to a dimming control input. In other words, as the current through the BSY LEDs is reduces as a result of dimming, a current can be increased through the additional LEDs, such as an amber LED. Increasing the light generated by the additional LEDs when the current provided through the BSY LEDs is being reduced can allow for the generation of the additional v' component described herein. Furthermore, it will be understood that although amber colored LEDs are described herein as being used to generate the additional v' component, any color LED that provides a sufficient v' component over a range of dimming provided to the apparatus can be utilized in embodiments according to the invention.

Figure 4:
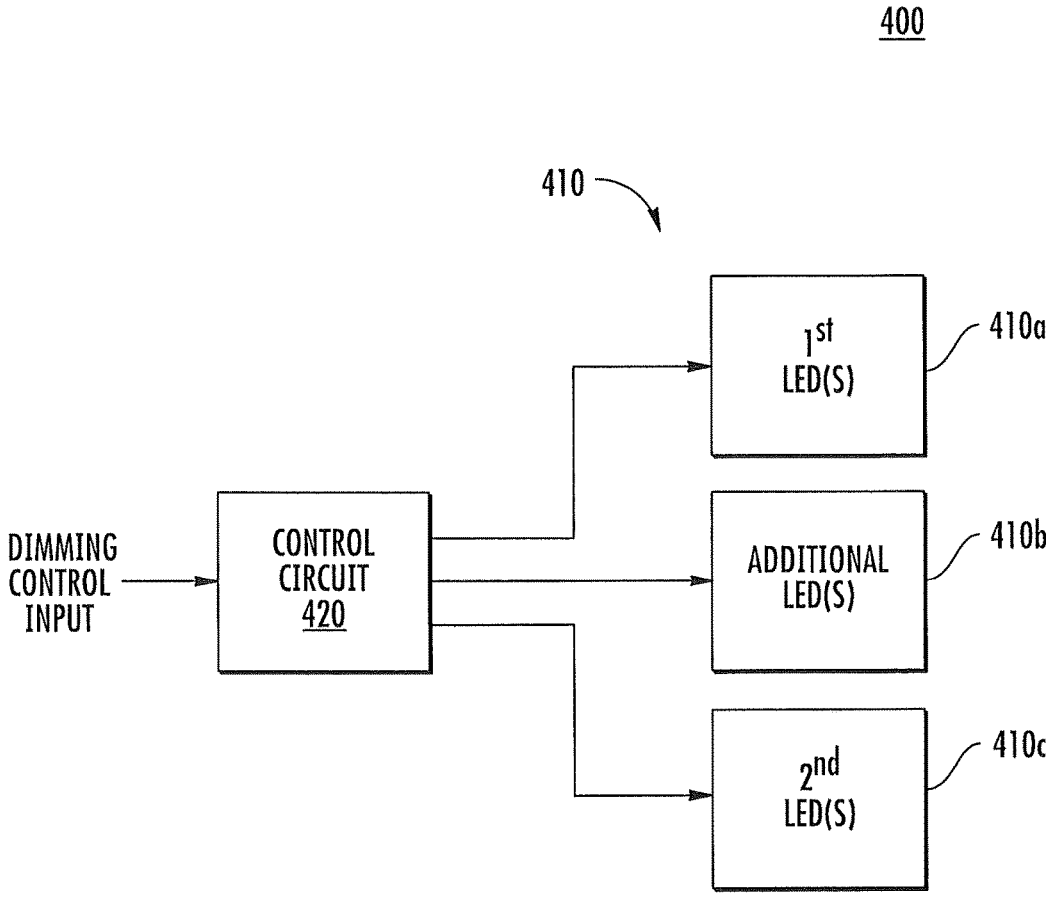
FIG. 4 is a block diagram illustrating a lighting apparatus in some embodiments according to the invention.

FIG. 4 is a block diagram illustrating an apparatus 400 including a plurality of LEDs in some embodiments according to the invention. As shown in FIG. 4, a control circuit 420 is provided with a dimming control input to affect the overall brightness level provided by the apparatus 400. In particular, the control circuit 420 can control current provided through a plurality of LEDs in response to the dimming control input to affect the brightness of the apparatus 400.

As further shown in FIG. 4, the plurality of LEDs 410 can include first LEDs (such as blue-shifted-yellow LEDs) 410A, second LEDs (such as red/orange LEDs) 410C, and additional LEDs (such as amber LEDs) 410B. The first LEDs 410A are configured to emit first light of a first chromaticity, the second LEDs 410C are configured to emit second light of a second chromaticity, and the additional LEDs 410B are configured to emit third light of a third chromaticity. It will be further understood that the embodiments illustrated in FIG. 4 are described hereinbelow using exemplary chromaticities for certain ones of the LEDs in the plurality of LEDs 410, although no limitation is intended by the use of these exemplary chromaticities.

It will be understood that the control circuit 420 is operatively coupled to the plurality of LEDs 410 so as to reduce current through at least one of, for example, the BSY LEDs 410A while increasing the current through at least one of the additional LEDs 410B. This operation can then cause a color temperature that is produced by the plurality of LEDs 410 that varies substantially in conformance with the Planckian locus in response to a dimming control input. Moreover, as a level of dimming provided by the dimming control input approaches a level whereupon a portion of the Planckian locus 325 shown in FIG. 3 is to be followed, the current through the additional LEDs 410 can be increased to provide the additional v' component 320 while the current of the BSY LEDs 410A is reduced which would otherwise cause the light output to follow the path 330 shown in FIG. 3 along the locus 315, which may be significantly removed from the Planckian locus 300.

It will be understood that the control circuit 420 can be provided based, with the addition of the teaching provided herein, on the systems, circuits, and methods described in commonly assigned U.S. patent application Ser. No. 12/566,195 entitled "Solid State Lighting Apparatus with Controllable Bypass Circuits and Methods of Operating Thereof", co-pending and commonly assigned U.S. patent application Ser. No. 12/704,730 entitled "Solid State Lighting Apparatus with Compensation Bypass Circuits and Methods of Operation Thereof" and co-pending and commonly assigned U.S. patent application Ser. No. 12/566,142 entitled "Solid State Lighting Apparatus with Configurable Shunts", the disclosures of which are incorporated herein by reference. Temperature compensation is described in co-pending and commonly assigned U.S. patent application Ser. No. 13/565,166, entitled "Temperature Curve Compensation Offset" the disclosure of which is incorporated herein by reference. The operations described therein can be applied to the present disclosure to control the bypass circuits to provide, for example, dimming control and temperature compensation for the lighting apparatus.

Figure 5:
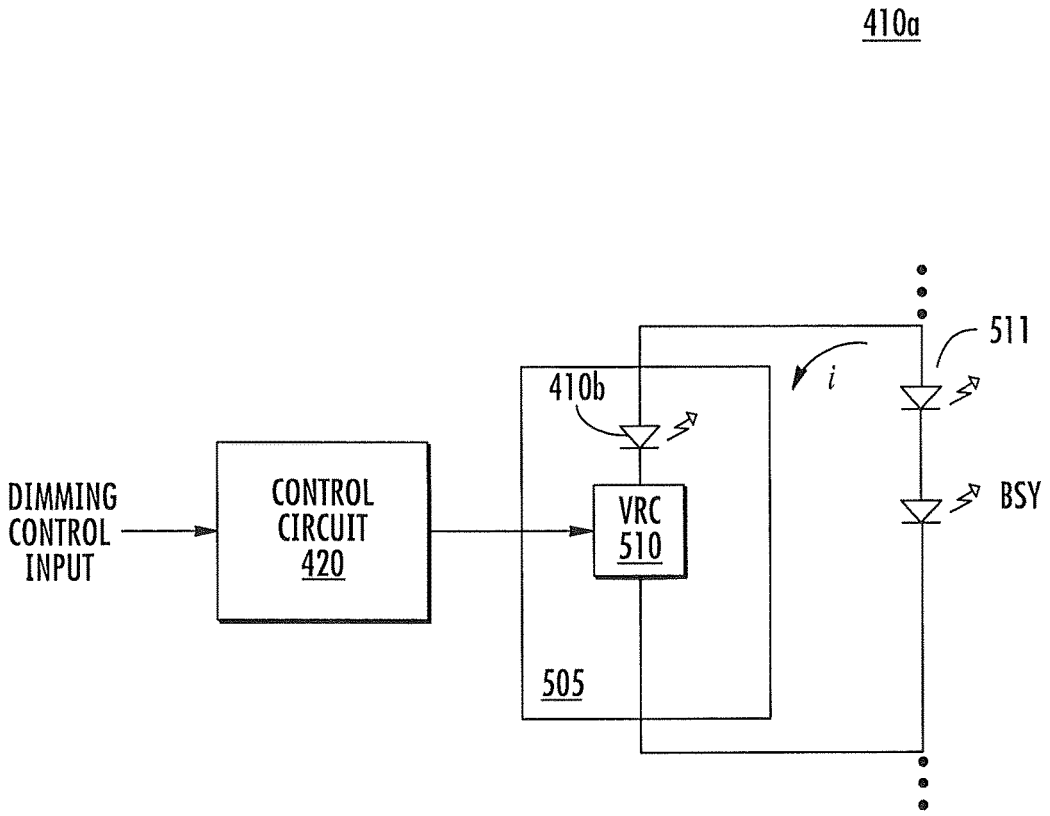
FIG. 5 is a schematic diagram illustrating a bypass circuit coupled to a control circuit and a plurality of LEDs in some embodiments according to the invention.

FIG. 5 is a schematic diagram illustrating a bypass circuit 505 (sometimes referred to as a shunt) operatively coupled to the control circuit 420 and to BSY LEDs 511 in some embodiments according to the invention. According to FIG. 5, the bypass circuit 505 is coupled in parallel with the portion of the plurality of LEDs 410 that include at least one of the BSY LEDs 511.

The bypass circuit 505 includes at least one of the additional LED 410B coupled in series with a variable resistance circuit 510 both of which are coupled in parallel with the BSY LEDs 511. In operation, the dimming control input is provided to the control circuit 420 to indicate that the brightness level of the apparatus should be reduced. In response, the control circuit 420 changes the resistance provided by the variable resistance circuit 510 so as to bypass additional current i from the BSY LEDs 511 through the at least one additional LED 410B, therefore causing the at least one additional LED 410B to emit light to provide the additional v' component described above in reference to FIG. 3. Additionally, the current provided to the BSY LEDs 511 is reduced so as to provide the bypass current to the at least one additional LED 410. As the dimming control input indicates the brightness level should be further reduced, the amount of current bypassed through the at least one additional LED 410B by the variable resistance circuits 510 can be increased, thereby causing additional light output from the at least one additional LED 410B, whereas the current through the BSY LEDs 511 is further reduced.

Figure 6:
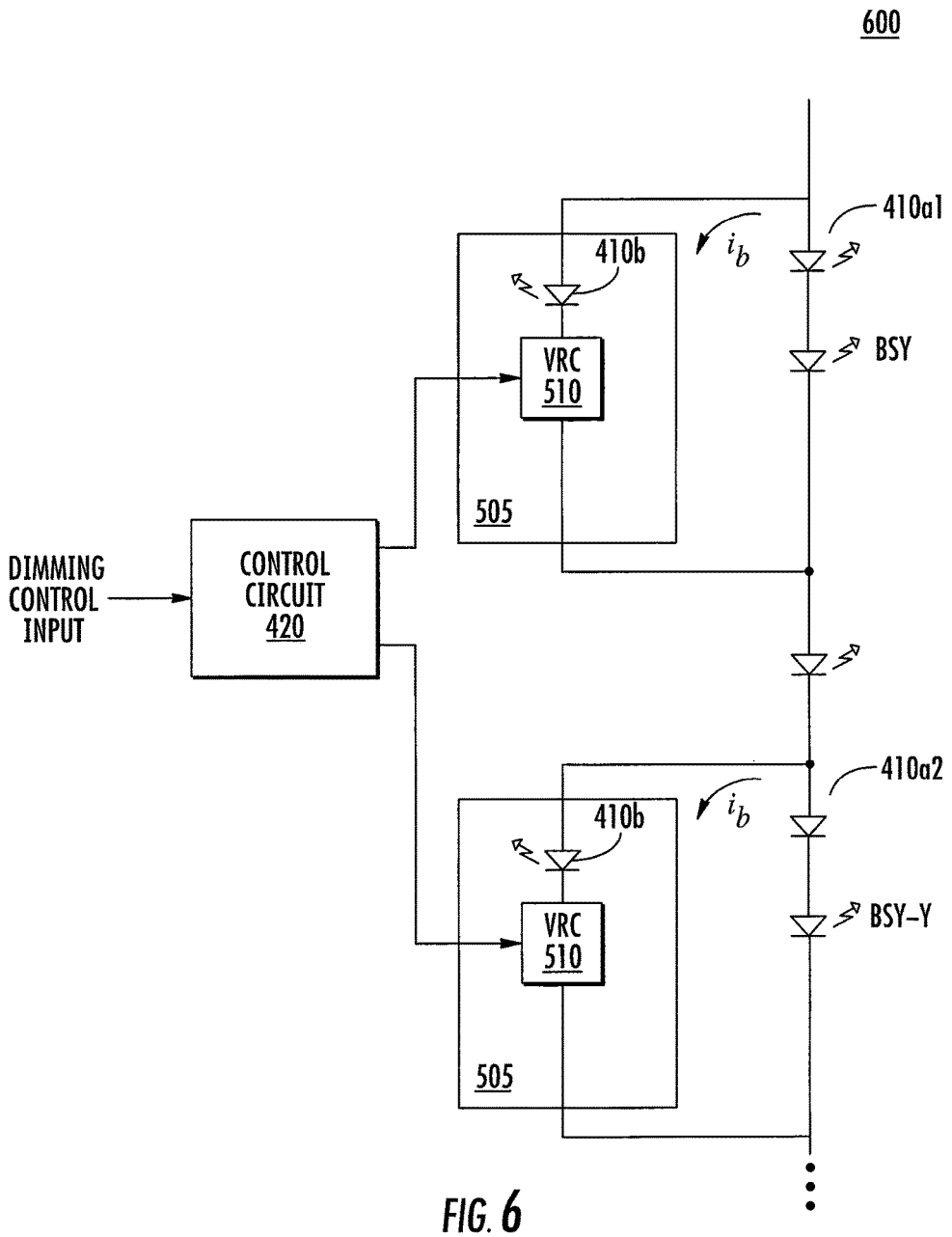
FIG. 6 is a schematic diagram illustrating first and second bypass circuits coupled to a control circuit and across different ones of the LEDs in some embodiments according to the invention.

FIG. 6 is a schematic diagram illustrating a lighting apparatus 600 including a plurality of LEDs 410 coupled to a plurality of bypass circuits in some embodiments according to the invention. According to FIG. 6, a dimming control input is provided to the control circuit 420 which in turn controls a first bypass circuit 505 coupled to a first group of BSY LEDs 410*a*1 and a second bypass circuit 505 coupled in parallel with a second set of BSY LEDs 410*a*2. It will be understood that the second set of BSY LEDs 410*a*2 includes LEDs which emit yellower content light compared to the light emitted by BSY LEDs 410*a*1.

Each of the bypass circuits 505 includes a variable resistance circuit 510 that is operatively coupled to the control circuit 420. Each of the bypass circuits 505 also includes at least one additional LED 410A coupled in series therewith so that when the control circuit 420 changes the resistance provided by the variable resistance circuit 510 in each of the bypass circuits, the amount of current $i_b$ provided through each of the at least one additional LEDs 410A varies, thereby changing the amount of light emitted by the additional LEDs 410A. Accordingly, as shown in FIG. 6, in some embodiments according to the invention, the additional LEDs can be provided in multiple bypass circuits coupled across different ones of the LEDs included in the plurality of LEDs 400.

Figure 7:
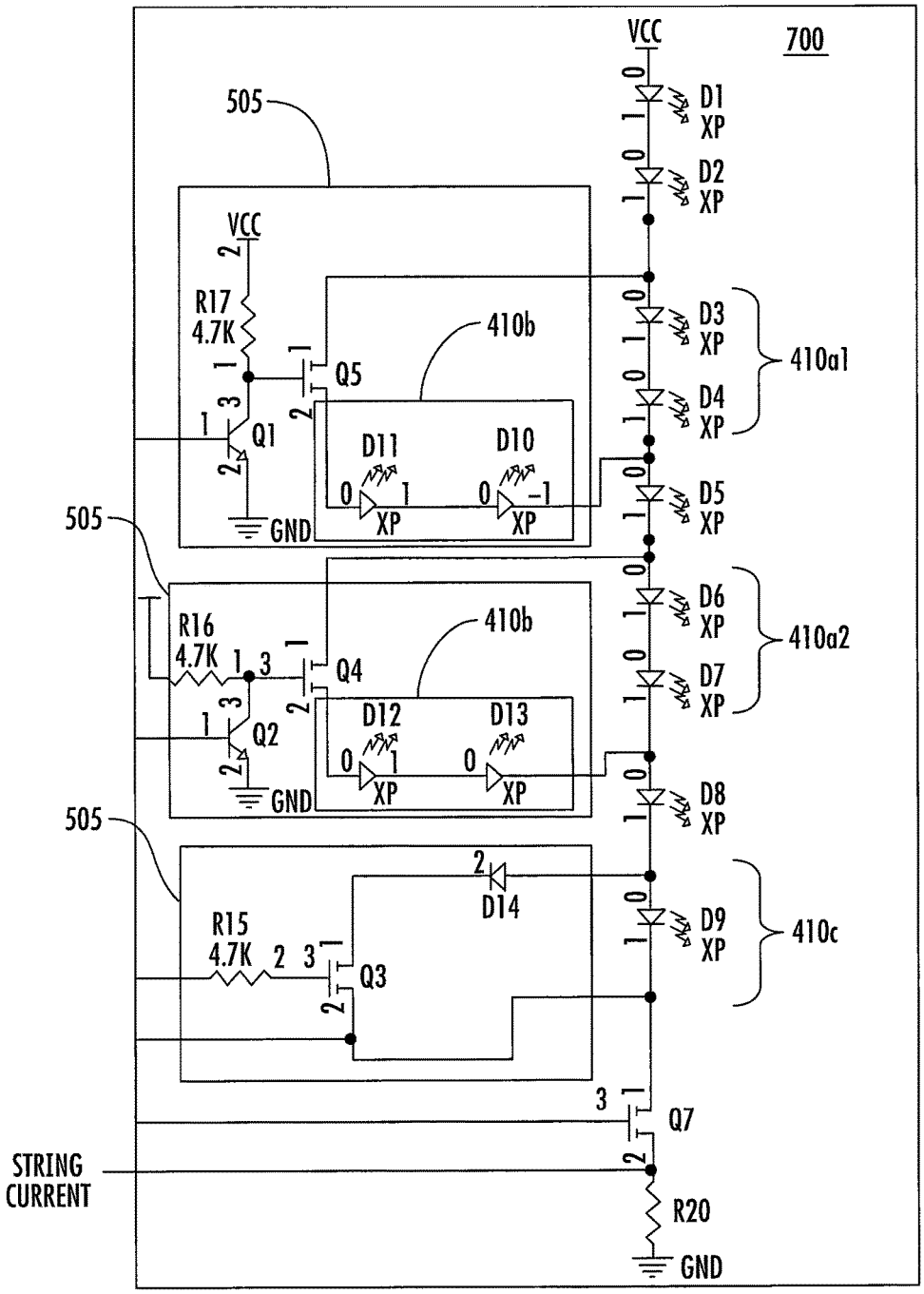
FIG. 7 is a schematic diagram illustrating bypass circuits coupled across respective LEDs in some embodiments according to the invention.

FIG. 7 is a detailed schematic diagram for a lighting apparatus 700 including the plurality of LEDs and bypass circuits coupled thereto with additional LEDs included therewith in some embodiments according to the invention. According to FIG. 7, amber LEDs provide the additional LEDs included with the bypass circuits 505 coupled across the BSY LEDs 410*a*1 and BSY LEDs 410*a*2, respectively. In particular, each of the bypass circuits 505 provides a transistor based variable resistance circuit which is operatively coupled to the control circuit 420 to vary the amount of current provided through the amber LEDs included in the bypass circuits 505.

In operation, the variable resistance circuits included with the bypass circuits 505 are configured to maintain proper operation of the transistors Q4 and Q5 during dimming. For example, the amber LEDS included in the bypass circuits 505 are selected to provide proper biasing to the transistors Q4 and Q5 so that during dimming, the transistors Q4 and Q5 may be maintained in saturation mode so that the current can continue to flow through the amber LEDs to provide the additional v' component described above in reference to FIG. 3.

It will be understood that the bypass circuit 504 shown coupled across the red/orange LEDs 410C may not include amber LEDs, but can include non-light emitting diodes to provide proper biasing of the transistor Q3. It will be further understood that the resistor R20 can be used to indicate the current through the LED string to the control circuit (via the voltage across r20). The LED string current can be used to control the bypass circuits as described herein. The temperature associated with the LED string can also be used by the control circuit to control the bypass circuits, using, for example, a 47.5K Ohm thermistor.

Figure 8:
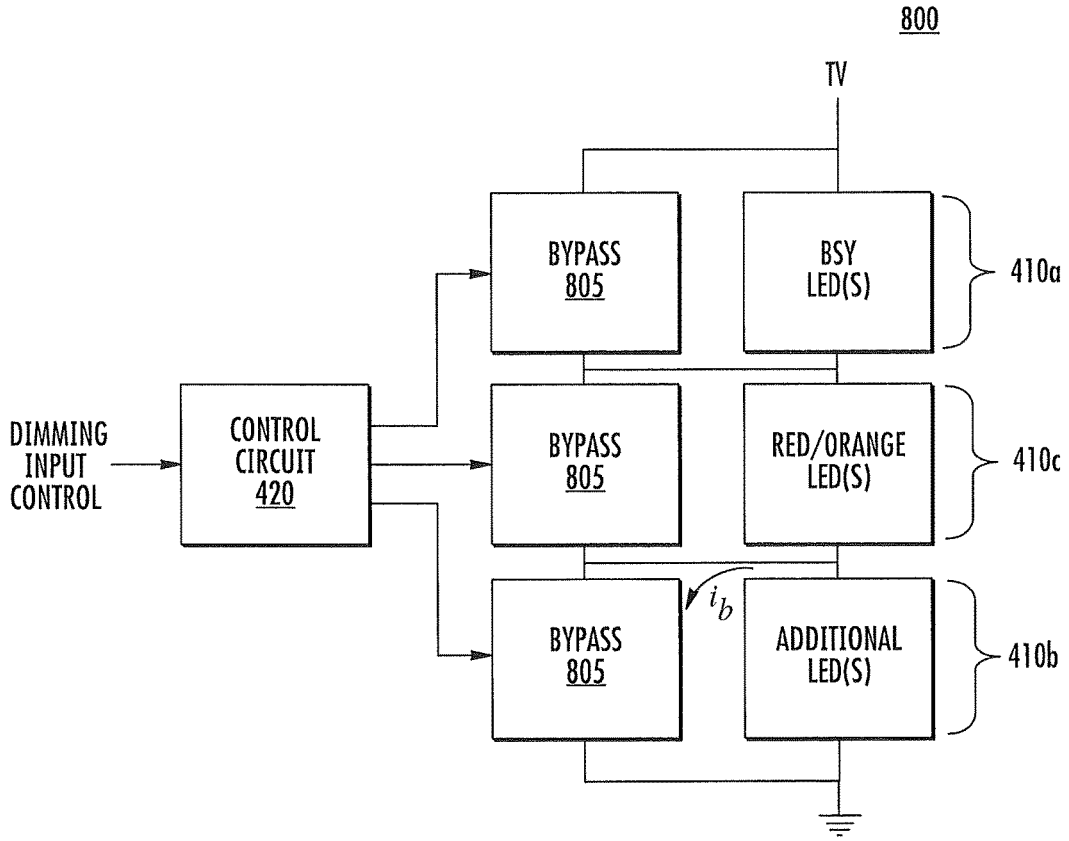
FIG. 8 is a block diagram illustrating several bypass circuits coupled across the LEDs in some embodiments according to the invention.

FIG. 8 is a block diagram that illustrates operations of a lighting apparatus 800 in some embodiments according to the invention. According to FIG. 8, the plurality of LEDs included in the lighting apparatus includes at least one BSY LED 410A coupled in series with at least one red/orange LED 410C which is coupled in series with at least one additional LED 410B. The lighting apparatus 800 also includes corresponding bypass circuits 805 coupled in parallel with each of the LEDs 410A-C. It will be understood that the bypass circuits 805 coupled across the at least one blue LED 410A and the at least one red/orange LED 410C can be utilized to effect the brightness level of the lighting apparatus 800 in response to the dimming input control provided to the control circuit 420.

Still further, the bypass circuit 805 coupled in parallel with the at least one additional LED 410B is configured to bypass current around the at least one additional LED 410B until significant dimming of the lighting apparatus 800 is to be provided. In other words, the bypass circuit 805 is configured to conduct current around the at least one additional LED 410B so that the additional v' component provided by the at least one additional LED 410B is not provided until a level of dimming that calls for the additional v' component. At this dimming level, the control circuit 420 can affect the operation of the bypass circuit 805 so as to reduce the current $i_b$ as the dimming input control increases thereby increasing the amount of current provided through the at least one additional LED 410B to provide the additional v' component to maintain operation of the lighting apparatus 800 in substantial conformance with the Planckian locus in response to the dimming input control.

Figure 9:
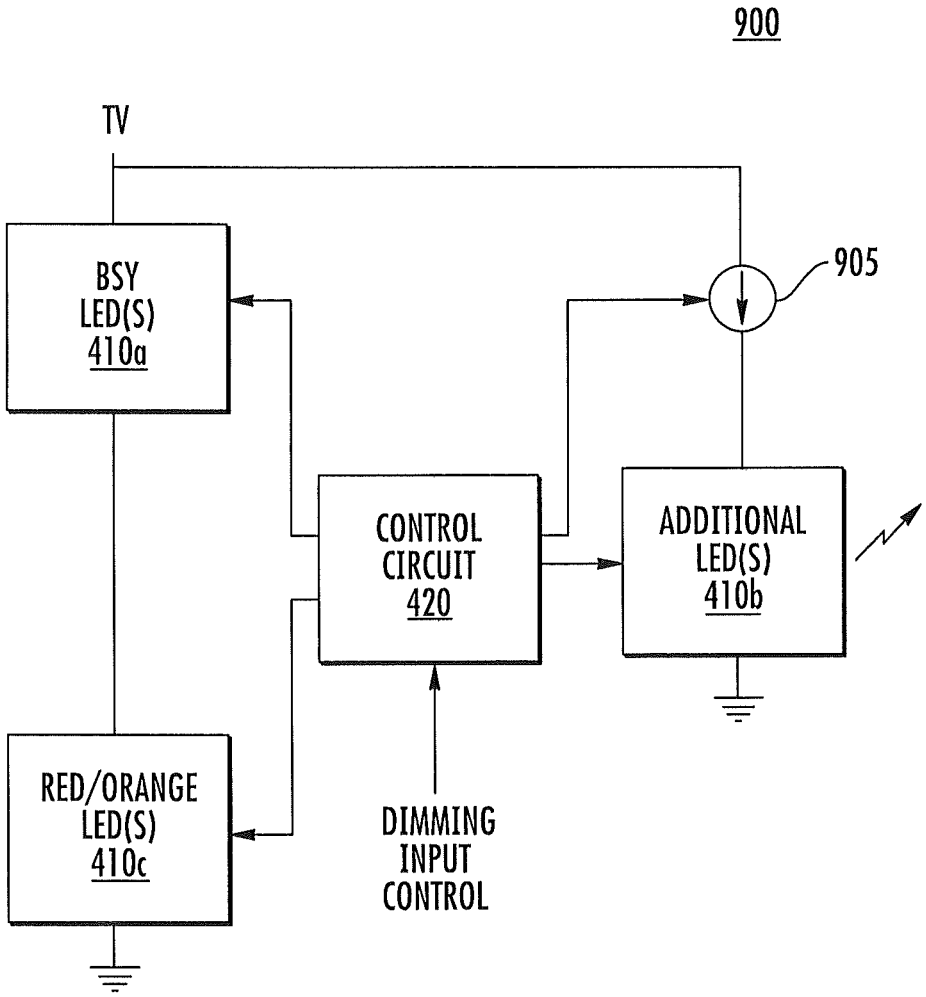
FIG. 9 is a block diagram illustrating a control circuit coupled to different LEDs in some embodiments according to the invention.

FIG. 9 is a block diagram that illustrates the plurality of LEDs provided in separate strings in a lighting apparatus 900 in some embodiments according to the invention. According to FIG. 9, the at least one BSY LED 410A is coupled in series with the at least one red/orange LED 410C, both of which are operatively coupled to the control circuit 420. In operation, the control circuit 420 can modify the current provided through the at least one BSY LED 410A and the at least one red/orange LED 410C to effect the overall brightness level provided by the lighting apparatus 900. In addition, the control circuit 420 is operatively coupled to the additional LEDs 410B which are coupled in parallel with the string of BSY and red/orange LEDs 410A and C.

In operation, the control circuit 420 can affect operation of the additional LEDs 410B to increase the current drawn therethrough as the dimming input control increases. Therefore, as the current drawn through the serial connection of the BSY LEDs 410A and the red/orange LEDs 410C is reduced, the current drawn through the additional LEDs 410B can be increased to provide the additional v' component described above. In some embodiments according to the invention, the control circuit 420 can also be operatively coupled to a current source 905 which can also vary the amount of current provided to the additional LEDs 410B. Accordingly, the amount of light emitted by the additional LEDs 410B can be controlled both by a bypass circuit as described herein, as well as varying the current source 905. In some embodiments according to the invention, the current source 905 is provided without the use of a bypass circuit in association with the additional LEDs 410B.

Figure 10:
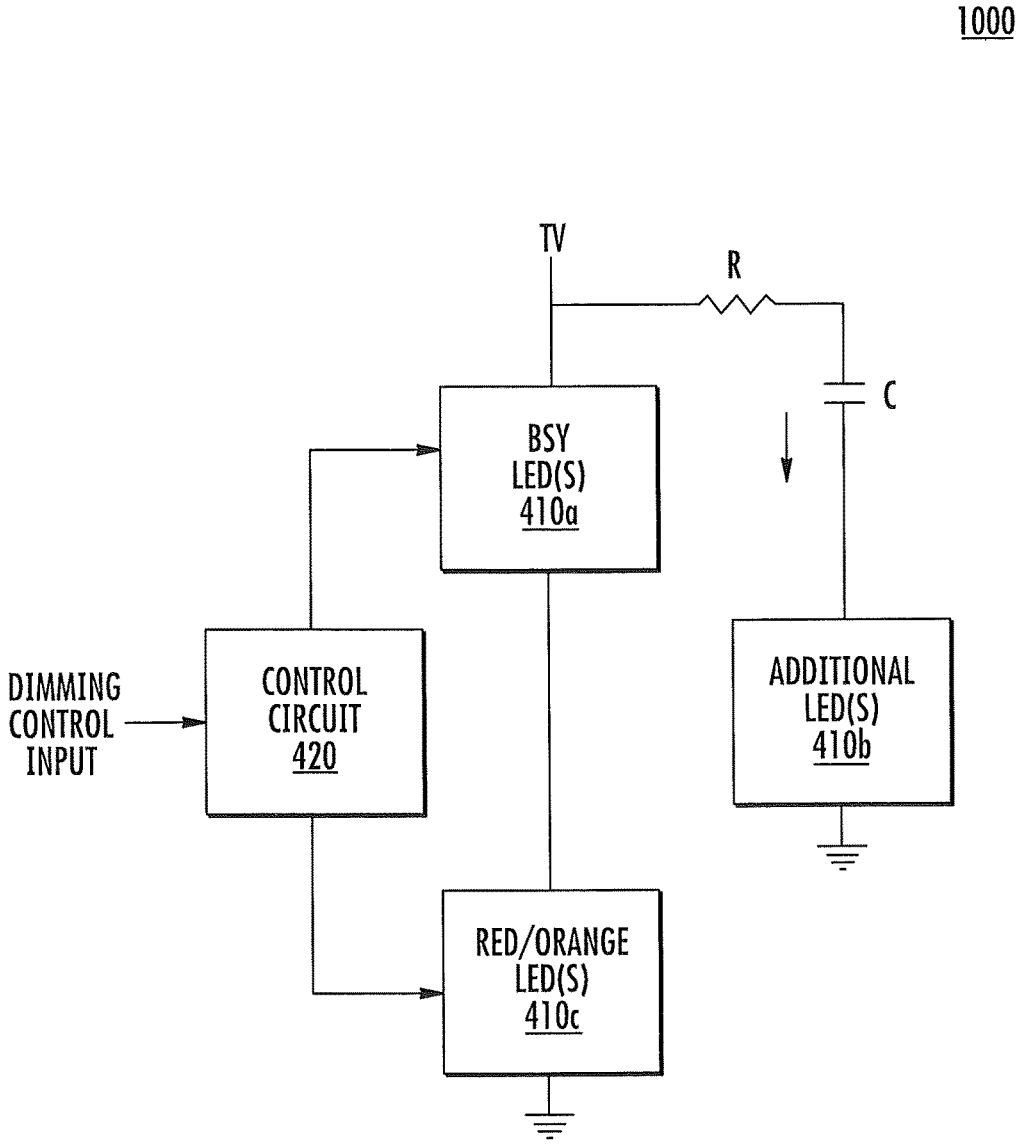
FIG. 10 is a block diagram illustrating a control circuit coupled to selective ones of the LEDs, coupled in parallel with a serial combination of an RC circuit and additional LEDs in some embodiments according to the invention.

FIG. 10 is a block diagram illustrating a lighting apparatus 1000 in some embodiments according to the invention. According to FIG. 10, the BSY LEDs 410A and the red/orange LEDs 410C are coupled in series with one another and are both operatively coupled to the control circuit 420 that operates in response to the dimming control input. As further shown in FIG. 10, the additional LEDs 410B are coupled in series with an RC circuit both of which are coupled in parallel with the BSY LEDs 410A and the red/orange LEDs 410C. In operation, the RC circuit charges when the BSY LEDs 410A and the red/orange LEDs 410C are disabled by the control circuit 420. Periodically, the RC circuit will discharge to allow current to pass through the additional LEDs 410 thereby emitting light that provides the additional v' component described above in reference to FIG. 3. Specifically, in operation, the capacitor can be charged, which can be stored until dimming progresses, whereupon the charge can be released to provide the light from the additional LED(s), such as amber LED(s), to help provide the additional v' light component.

In the drawings and specification, there have been disclosed typical preferred embodiments of the inventive subject matter and, although specific terms are employed, they are used in a generic and descriptive sense only and not for purposes of limitation, the scope of the inventive subject matter being set forth in the following claims.

What is claimed:

1. A lighting apparatus comprising:

a plurality of light-emitting devices (LEDs) comprising at least one first LED configured to emit first chromaticity light, at least one second LED configured to emit second chromaticity light, and at least one additional LED configured to emit third chromaticity light, wherein the at least one second LED comprises a Blue-Shifted-Yellow (BSY) LED, and the at least one additional LED comprises at least one amber LED;

a control circuit operatively coupled to the plurality of LEDs and configured to operate the at least one additional LED to cause a color temperature of light produced by the plurality of LEDs to vary substantially in conformance with a Planckian locus responsive to a dimming control input provided to the plurality of LEDs; and a bypass circuit, operatively coupled to the control circuit, the bypass circuit including a variable resistance circuit and the at least one amber LED coupled in series with the variable resistance circuit, wherein the variable resistance circuit is configured to continuously alter a resistance of the variable resistance circuit to increasingly bypass current around the at least one BSY LED through the at least one amber LED as the dimming control input decreases a brightness level of the light produced by the plurality of LEDs, wherein the variable resistance circuit comprises a transistor, and wherein the at least one amber LED is configured to provide biasing to the transistor to maintain the transistor in saturation mode during a dimming operation of the apparatus to provide an additional v' component in a u'-v' coordinate system to the color temperature of the light produced by the plurality of LEDs.

2. The apparatus of claim 1 wherein the at least one first LED comprises a red/orange LED.

3. The apparatus of claim 2 wherein the plurality of LEDs comprises:

a first LED string including the at least one BSY LED coupled in series with the at least one red/orange LED; and a second LED string, coupled in parallel with the first LED string, including the at least one amber LED, wherein the control circuit is configured to increase current through the first LED string while decreasing current through the second string of LEDs as the dimming control input increases the brightness level of the light produced by the plurality of LEDs.

4. The apparatus of claim 3 wherein the bypass circuit is configured to increasingly bypass current around the at least one amber LED as the dimming control input increases the brightness level of the light produced by the plurality of LEDs.

5. The apparatus of claim 1 wherein the at least one BSY LED comprises a first BSY LED configured to emit first BSY light and the plurality of LEDs comprises a second BSY LED configured to emit second BSY light having greater yellow content than the first BSY light, the apparatus further comprising:

a second bypass circuit, operatively coupled to the control circuit, the second bypass circuit including a second variable resistance circuit and a second amber LED coupled in series with the second variable resistance circuit, wherein the second variable resistance circuit is configured to continuously alter a resistance of the second variable resistance circuit to increasingly bypass current around the second BSY LED through the second amber LED as the dimming control input decreases the brightness level of the light produced by the plurality of LEDs.

6. The apparatus of claim 1 wherein the control circuit is further configured to operate the bypass circuit to increasingly bypass current around the at least one BSY LED through the at least one amber LED responsive to the dimming control input that decreases the color temperature of the light produced by the plurality of LEDs to less than about 1800K.

7. A lighting apparatus comprising:

a plurality of light-emitting devices (LEDs) comprising at least one first LED configured to emit first chromaticity light, at least one second LED configured to emit second chromaticity light, and at least one additional LED configured to emit third chromaticity light, wherein the at least one first LED comprises a red/orange LED, the at least one second LED comprises a Blue-Shifted-Yellow (BSY) LED, and the at least one additional LED comprises at least one amber LED;

a control circuit operatively coupled to the plurality of light-emitting devices and configured to operate the at least one additional LED to cause a color temperature produced by the plurality of LEDs to vary substantially in conformance with a Planckian locus responsive to a dimming control input provided to the plurality of LEDs;

wherein the plurality of LEDs comprises:

a first LED string including the at least one BSY LED coupled in series with the at least one red/orange LED;

a second LED string, coupled in parallel with the first LED string, including the at least one amber LED; and an RC circuit coupled in series with the second LED string, and configured to discharge through the second LED string when the first string of LEDs is off.

8. The apparatus of claim 7 wherein the RC circuit is not in series with the first LED string.

9. The apparatus of claim 1 wherein the transistor is a first transistor, and wherein the bypass circuit comprises a second transistor configured to alter a gate voltage of the first transistor responsive to the control circuit.

10. A lighting apparatus comprising:

a control circuit operatively coupled to a plurality of light-emitting devices (LEDs) and configured to reduce current through at least one first chromaticity LED included in the plurality of LEDs by bypassing current from the at least one first chromaticity LED through at least one additional chromaticity LED included in the plurality to increase current through the at least one additional chromaticity LED and cause a color temperature of light produced by the plurality of LEDs to vary substantially in conformance with a Planckian locus responsive to a dimming control input provided to the plurality of LEDs, wherein the at least one first chromaticity LED comprises at least one Blue-Shifted-Yellow (BSY) LED configured to emit BSY light and the at least one additional chromaticity LED comprises at least one additional LED configured to emit additional light; and a bypass circuit, operatively coupled to the control circuit, the bypass circuit including a variable resistance circuit and the at least one additional LED coupled in series with the variable resistance circuit, wherein the variable resistance circuit is configured to continuously alter a resistance of the variable resistance circuit to increasingly bypass current around the at least one BSY LED through the at least one additional LED as the dimming control input decreases a brightness level of the light produced by the plurality of LEDs, wherein the variable resistance circuit comprises a transistor, wherein the at least one additional LED is configured to provide biasing to the transistor, wherein the at least one additional LED comprises at least one amber LED configured to emit amber light, and wherein the at least one amber LED is configured to provide biasing to maintain the transistor in saturation mode during a dimming operation of the apparatus to provide an additional v' component in a u'-v' coordinate system to the color temperature of the light produced by the plurality of LEDs.

11. The apparatus of claim 10 wherein the plurality of LEDs further comprises at least one red/orange LED configured to emit red/orange light.

12. The apparatus of claim 11 wherein the plurality of LEDs comprises:

a first LED string including the at least one BSY LED coupled in series with the at least one red/orange LED; and a second LED string, coupled in parallel with the first LED string, including the at least one additional LED, wherein the control circuit is configured to increase current through the first LED string while decreasing current through the second string of LEDs as the dimming control input increases the brightness level of the light produced by the plurality of LEDs.

13. The apparatus of claim 12 wherein the bypass circuit is configured to increasingly bypass current around the at least one additional LED as the dimming control input increases the brightness level of the light produced by the plurality of LEDs.

14. The apparatus of claim 10 wherein the additional light comprises a predominant non-blue color.

15. The apparatus of claim 10 wherein the control circuit is configured to reduce the current through the at least one BSY LED while increasing the current through the at least one additional LED at brightness levels less than about 30% of a maximum brightness level.

16. The apparatus of claim 10 wherein the additional light comprises a wavelength in a range from about 585 nm to about 500 nm.

17. The apparatus of claim 10 wherein the at least one BSY LED comprises a first BSY LED configured to emit first BSY light and the plurality of LEDs comprises a second BSY LED configured to emit second BSY light having greater yellow content than the first BSY light, the apparatus further comprising:

a second bypass circuit, operatively coupled to the control circuit, the second bypass circuit including a second variable resistance circuit and a second additional LED coupled in series with the second variable resistance circuit, wherein the second variable resistance circuit is configured to continuously alter a resistance of the second variable resistance circuit to increasingly bypass current around the second BSY LED through the second additional LED as the dimming control input decreases the brightness level of the light produced by the plurality of LEDs.

18. The apparatus of claim 10 wherein the control circuit is further configured to operate the bypass circuit to increasingly bypass current around the at least one BSY LED through the at least one additional LED responsive to the dimming control input that decreases the color temperature of the light produced by the plurality of LEDs to less than about 1800K.

19. The apparatus of claim 10 wherein the transistor is a first transistor, and wherein the bypass circuit comprises a second transistor configured to alter a gate voltage of the first transistor responsive to the control circuit.

20. A method of operating a lighting apparatus including a plurality of light-emitting devices (LEDs) comprising at least one first LED configured to emit first chromaticity light, at least one second LED configured to emit second chromaticity light, and at least one additional LED configured to emit additional chromaticity light, the method comprising:

diverting current from the at least one second LED through the at least one additional LED to cause a color temperature of light produced by the plurality of LEDs to vary substantially in conformance with a Planckian locus responsive to a dimming control input, wherein the at least one first LED comprises a red/orange LED configured to emit red/orange chromaticity light, the at least one second LED comprises a Blue-Shifted-Yellow (BSY) LED configured to emit BSY chromaticity light, and the at least one additional LED comprises an amber LED configured to emit amber chromaticity light, wherein the plurality of LEDs comprises a first LED string including the at least one BSY LED coupled in series with the at least one red/orange LED, a second LED string, coupled in parallel with the first LED string, including the at least one additional LED, the method further comprising:

discharging current through the second LED string when the first LED string switches off by an RC circuit coupled in series with the second LED string and not in series with the first LED string.

21. The method of claim 20 wherein the additional chromaticity light comprises a predominant non-blue color.

22. The method of claim 20 wherein diverting the current comprises reducing the current through the at least one BSY LED while increasing the current through the at least one additional LED at brightness levels less than about 30% of a maximum brightness level.

23. The method of claim 20 wherein the additional chromaticity light comprises a wavelength in a range from about 585 nm to about 500 nm.

24. The method of claim 20 wherein the at least one additional LED comprises at least one amber LED configured to emit amber light.

25. The method of claim 20 further comprising:

increasingly bypassing current around the at least one BSY LED through the at least one additional LED as the dimming control input decreases a brightness level of the light produced by the plurality of LEDs.

26. The method of claim 20 further comprising:

increasing current through the first LED string while decreasing current through the second string of LEDs as the dimming control input increases a brightness level of the light produced by the plurality of LEDs.

27. The method of claim 26 further comprising:

increasingly bypassing current around the at least one additional LED as the dimming control input increases the brightness level of the light produced by the plurality of LEDs.

* * * * *